US011136853B2

(12) United States Patent
Zonoz et al.

(10) Patent No.: US 11,136,853 B2
(45) Date of Patent: Oct. 5, 2021

(54) INFLATABLE PACKER SYSTEM FOR AN ANNULAR BLOWOUT PREVENTER

(71) Applicant: Cameron International Corporation, Houston, TX (US)

(72) Inventors: Ray Zonoz, Sugar Land, TX (US); Steven Shimonek, League City, TX (US); Nicolas Arteaga, Jersey Village, TX (US); Bruce Boulanger, Houston, TX (US); Taylor Mozisek, Katy, TX (US); Jeffrey Lambert, Tomball, TX (US); Ian McDaniel, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/713,822

(22) Filed: Dec. 13, 2019

(65) Prior Publication Data

US 2021/0180427 A1 Jun. 17, 2021

(51) Int. Cl.

| | |
|---|---|
| ***E21B 33/127*** | (2006.01) |
| ***E21B 33/128*** | (2006.01) |
| ***E21B 33/12*** | (2006.01) |

(52) U.S. Cl.

CPC ..... *E21B 33/127* (2013.01); *E21B 33/128* (2013.01); *E21B 33/1216* (2013.01)

(58) Field of Classification Search

CPC ... E21B 33/127; E21B 33/128; E21B 33/1216

USPC ..... 166/387

See application file for complete search history.

(56) References Cited

U.S. PATENT DOCUMENTS

| | | | | |
|---|---|---|---|---|
| 3,661,204 | A * | 5/1972 | Blanding | E21B 7/124 166/356 |
| 3,737,139 | A * | 6/1973 | Watts | F16L 17/10 277/324 |
| 4,007,904 | A * | 2/1977 | Jones | E21B 33/06 251/1.2 |
| 6,230,824 | B1 * | 5/2001 | Peterman | E21B 21/01 175/214 |
| 2009/0090502 | A1 * | 4/2009 | Lumbye | E21B 43/26 166/120 |
| 2009/0101351 | A1 * | 4/2009 | Hannegan | E21B 33/085 166/350 |
| 2017/0058624 | A1 * | 3/2017 | Jaffrey | E21B 33/06 |
| 2018/0142543 | A1 * | 5/2018 | Gupta | E21B 33/0355 |

FOREIGN PATENT DOCUMENTS

| | | |
|---|---|---|
| WO | 2017/109506 A2 | 6/2017 |
| WO | 2017/109508 A1 | 6/2017 |
| WO | 2017/109509 A1 | 6/2017 |

* cited by examiner

*Primary Examiner* — Taras P Bemko

(57) ABSTRACT

An inflatable packer system for an annular blowout preventer (BOP) includes an inflatable bladder configured to be positioned within a housing of the annular BOP and to inflate upon receipt of a fluid within the inflatable bladder. The inflatable bladder may be an annular structure that is configured to circumferentially surround a bore of the annular BOP.

13 Claims, 9 Drawing Sheets

INFLATABLE PACKER SYSTEM FOR AN ANNULAR BLOWOUT PREVENTER

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

An annular blowout preventer (BOP) is installed on a wellhead to seal and control an oil and gas well during drilling operations. A drill string may be suspended inside the oil and gas well from a rig through the annular BOP into the wellbore. During drilling operations, a drilling fluid is delivered through the drill string and returned up through an annulus between the drill string and a casing that lines the wellbore. In the event of a rapid invasion of formation fluid in the annulus, commonly known as a "kick," the annular BOP may be actuated to seal the annulus and to control fluid pressure in the wellbore, thereby protecting well equipment disposed above the annular BOP. Characteristics of a packer assembly of the annular BOP can affect the ability of the annular BOP to seal the annulus.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to annular blowout preventers (BOPs). In particular, the present embodiments are generally directed to annular BOPs that include an inflatable bladder (e.g., bag, container) that is configured to inflate (e.g., expand; adjust from a deflated state to an inflated state) upon receipt of a fluid (e.g., liquid or gas). Inflation of the inflatable bladder may cause the annular BOP to transition from an open position to a closed position to seal an annulus around a conduit disposed through a central bore of the annular BOP or to close the central bore. For example, upon inflation, the inflatable bladder may drive a packer and multiple inserts radially-inwardly such that the packer contacts the conduit and seals the annulus around the conduit. In some embodiments, upon inflation, the inflatable bladder may expand such that the inflatable bladder contacts the conduit and seals the annulus around the conduit.

While the disclosed embodiments are described in the context of a drilling system and drilling operations to facilitate discussion, it should be appreciated that the annular BOP may be adapted for use in other contexts and other operations. For example, the annular BOP may be used in a pressure control equipment (PCE) stack that is coupled to and/or positioned vertically above a wellhead during various intervention operations (e.g., inspection or service operations), such as wireline operations in which a tool supported on a wireline is lowered through the PCE stack to enable inspection and/or maintenance of a well. In such cases, the annular BOP may be adjusted from the open position to the closed position (e.g., to seal about the wireline extending through the PCE stack) to isolate the environment, as well as other surface equipment, from pressurized fluid within the well. In the present disclosure, a conduit may be any of a variety of tubular or cylindrical structures, such as a drill string, wireline, Streamline™, slickline, coiled tubing, or other spoolable rod.

Figure 1:
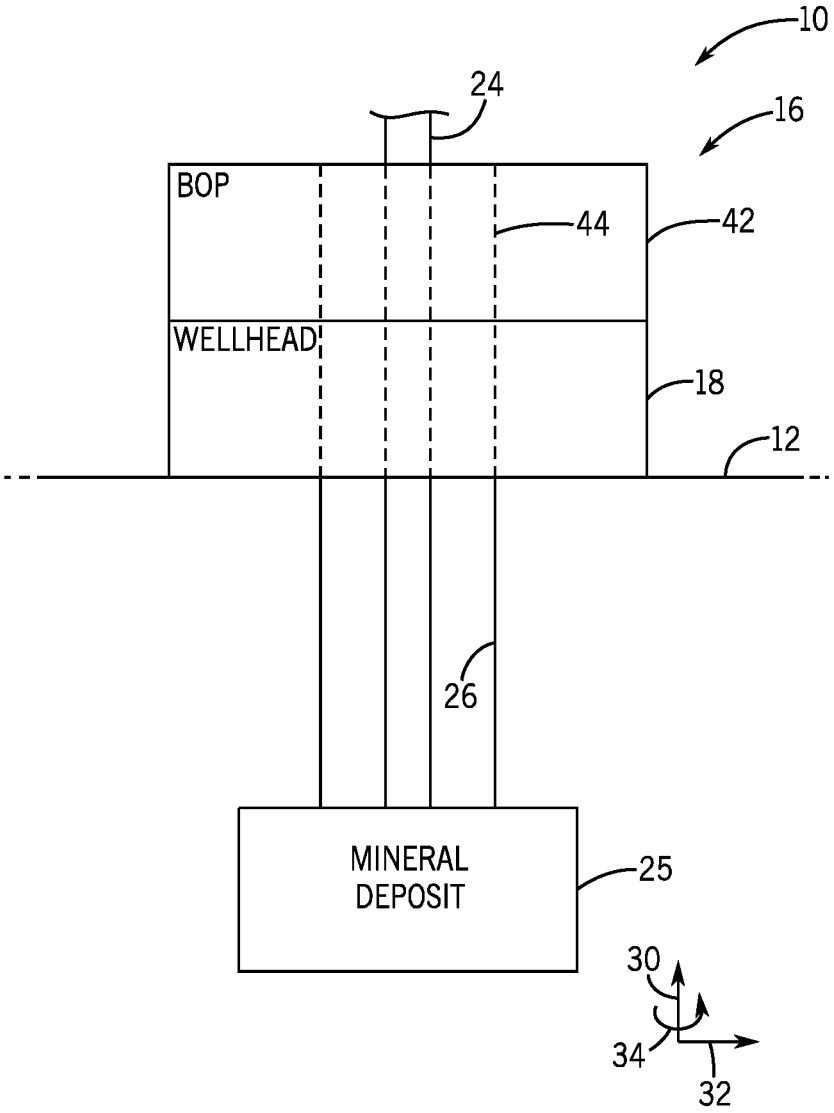
FIG. 1 is a block diagram of a mineral extraction system in accordance with an embodiment of the present disclosure.

With the foregoing in mind, FIG. 1 is a block diagram of an embodiment of a mineral extraction system 10. The mineral extraction system 10 may be configured to extract various minerals and natural resources, including hydrocarbons (e.g., oil and/or natural gas), from the earth, or to inject substances into the earth. The mineral extraction system 10 may be a land-based system (e.g., a surface system) or an offshore system (e.g., an offshore platform system). A BOP assembly 16 is mounted to a wellhead 18, which is coupled to a mineral deposit 25 via a wellbore 26 (e.g., a casing string within the wellbore 26). The wellhead 18 may include any of a variety of other components such as a spool, a hanger, and a "Christmas" tree. The wellhead 18 may return drilling fluid or mud to the surface 12 during drilling operations, for example. Downhole operations are carried out by a conduit 24 that extends through the BOP assembly 16, through the wellhead 18, and into the wellbore 26.

To facilitate discussion, the BOP assembly 16 and its components may be described with reference to an axial axis or direction 30, a radial axis or direction 32, and a circumferential axis or direction 34. The BOP assembly 16 may include one or more annular BOPs 42. A central bore 44 (e.g., flow bore) extends through the one or more annular BOPs 42. As discussed in more detail below, at least one of the annular BOPs 42 may include an inflatable bladder that is configured to inflate upon receipt of a fluid. As the inflatable bladder inflates, the inflatable bladder may cause the annular BOP 42 to transition from an open position to a closed position to seal an annulus around the conduit 24 disposed through the central bore 44 of the annular BOP 42 or to close the central bore 44 (e.g., to block flow through the central bore 44).

Figure 2:
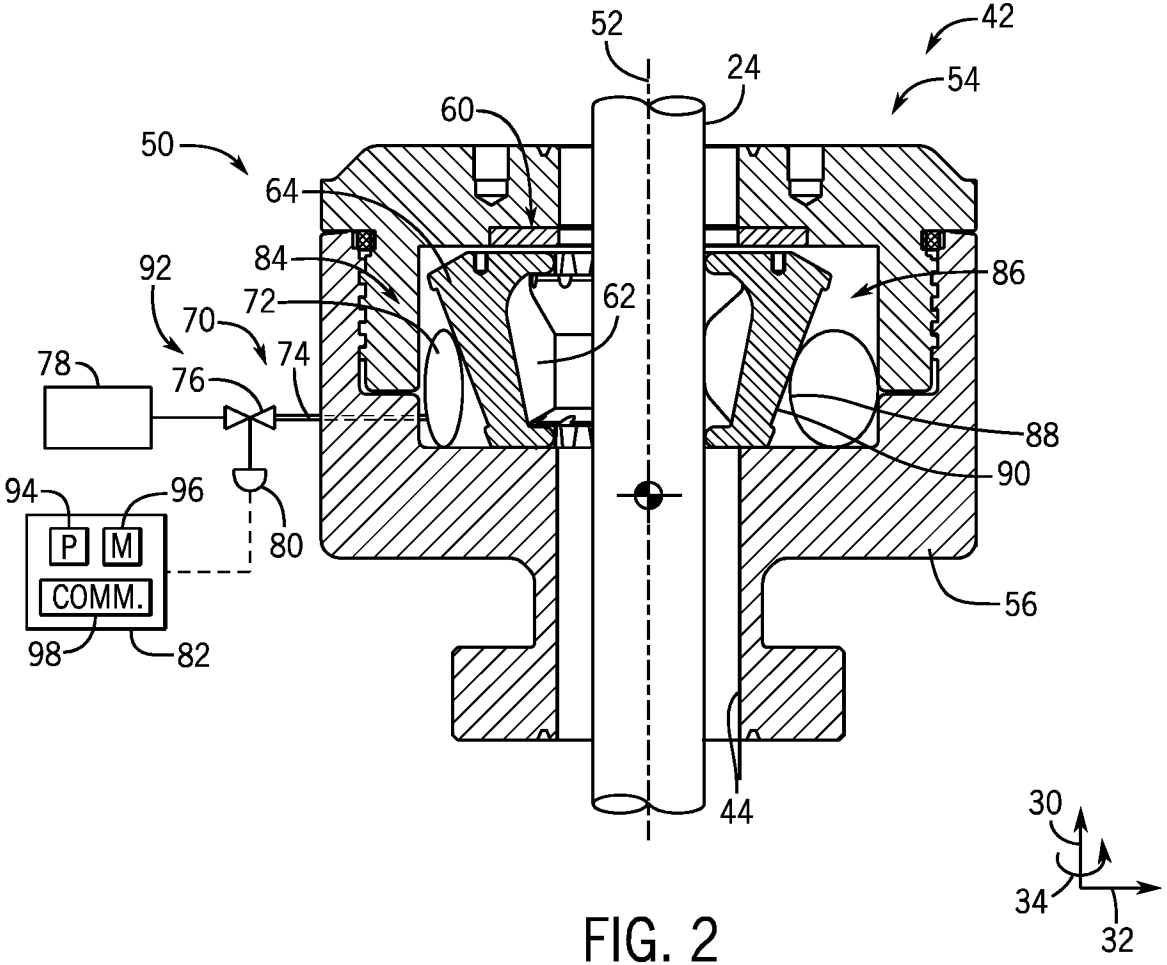
FIG. 2 is a cross-sectional side view of an embodiment of an annular BOP that may be used in the system of FIG. 1, wherein the annular BOP includes an inflatable bladder, a packer, and multiple inserts.

FIG. 2 is a cross-sectional side view of the annular BOP 42 that may be used in the system 10 of FIG. 1. To facilitate discussion, the annular BOP 42 is shown in an open position 50 on one side of a central axis 52 of the annular BOP 42, and the annular BOP 42 is shown in a closed position 54 on the other side of the central axis 52 of the annular BOP 42. In the open position 50, the annular BOP 42 may enable fluid flow through the central bore 44 of the annular BOP 42. In the closed position 54, the annular BOP 42 may block fluid flow through the central bore 44 of the annular BOP 42.

As shown, the annular BOP 42 includes a housing 56 (e.g., annular housing), and a packer assembly 60 (e.g., annular packer assembly) within the housing 56 includes a packer 62 (e.g., annular packer) and multiple inserts 64. The packer 62 may be a flexible component (e.g., elastomer) and the multiple inserts 64 may be rigid components (e.g., metal or metal alloy). The multiple inserts 64 may extend axially through the packer 62 and may be positioned at discrete circumferential locations about the packer 62.

As shown, the annular BOP 42 also includes an inflatable bladder system 70, which includes an inflatable bladder 72 (e.g., inflatable packer) positioned within the housing 56. In the illustrated embodiment, the inflatable bladder 72 is an annular structure that circumferentially surrounds the packer assembly 60, and the inflatable bladder 72 is positioned between the packer assembly 60 and side walls of the housing 56 along the radial axis 32. The inflatable bladder system 70 may also include an inflation conduit 74 (e.g., fluid conduit), a valve 76 configured to adjust a flow of a fluid (e.g., liquid or gas) from a fluid source 78, an actuator 80 configured to control the valve 76, and an electronic controller 82 that is configured to generate control signals to control the actuator 80. For example, upon an undesired increase in pressure within the wellbore (e.g., wellbore 26, FIG. 1), the electronic controller 82 may generate a control signal to instruct the actuator 80 to open the valve 76 to enable the flow of the fluid from the fluid source 78 to the inflatable bladder 72 via the inflation conduit 74. The fluid source 78 may also include or be associated with a pump, and the electronic controller 82 may control the pump to force the fluid into the inflatable bladder 72 even in the presence of the undesired increase in pressure within the wellbore. In some embodiments, the inflatable bladder system 70 may be configured to use the wellbore pressure as a booster to boost the pressure of the fluid within the inflatable bladder 72 (e.g., by diverting fluid from the wellbore to the inflatable bladder 72 and/or to a component that causes inflation of the inflatable bladder 72). In this way, the inflatable bladder system 70 may inflate the inflatable bladder 72 from a deflated state 84 to an inflated state 86 in response to the increase in pressure within the wellbore. The inflatable bladder 72 may have a first volume in the deflated state 84 and a second volume, greater than the first volume, in the inflated state 86.

In the illustrated embodiment, as the inflatable bladder 72 inflates, the inflatable bladder 72 may contact and exert a force (e.g., along the radial axis 32) on the packer assembly 60 that drives the packer assembly 60 radially-inwardly into the central bore 44 of the annular BOP 42, thereby enabling the packer 62 to contact and seal against the conduit 24 to block the fluid flow across the annular BOP 42. In particular, a radially-inner surface 88 (e.g. annular surface) of the inflatable bladder 72 contacts a radially-outer surface 90 (e.g., annular surface) of the packer assembly 60 to drive the packer assembly 60 radially-inwardly into the central bore 44 of the annular BOP 42, thereby enabling the packer 62 to contact and seal against the conduit 24 to block the fluid flow across the annular BOP 42.

The inflatable bladder system 70 may flow and/or force the fluid into the inflatable bladder 72 until the annular BOP 42 reaches the closed position 54 (e.g., as determined by the electronic controller 82 based on data obtained from a sensor, such as a pressure sensor, located vertically above the annular BOP 42), until the fluid stops flowing and/or cannot be forced into the inflatable bladder 72 (e.g., due to a maximum inflation of the inflatable bladder 72 being reached and/or a maximum compression of the packer assembly 60 against the conduit 24 being reached), and/or in response to some other condition. As shown, the inflatable bladder 72 may completely or substantially (e.g., approximately equal to or greater than 95, 90, 85, 80, or 75 percent) fill an annular space defined between the packer assembly 60 and the side walls of the housing 56 along the radial axis 32 while the inflatable bladder 72 is in the inflated state 86 and while the annular BOP 42 is in the closed position 54.

Together, the packer assembly 60 and the inflatable bladder system 70 may form an inflatable packer system 92. As shown, the electronic controller 82 includes a processor 94 and a memory device 96. In some embodiments, the processor 94 may receive and process signals from a sensor that monitors the pressure within the wellbore to determine that the annular BOP 42 should be adjusted from the open position 50 to the closed position 54. In some embodiments, the processor 94 may receive other signals (e.g., operator input) that indicate that the annular BOP 42 should be adjusted from the open position 50 to the closed position 54. Then, the processor 94 may provide control signals, such as to the actuator 80 to adjust the valve 76, in response to the determination or the indication that the annular BOP 42 should be adjusted from the open position 50 to the closed position 54.

The electronic controller 82 may be part of or include a distributed controller or control system with one or more electronic controllers in communication with one another to carry out the various techniques disclosed herein. The processor 94 may also include one or more processors configured to execute software, such as software for processing signals and/or controlling the components associated with the annular BOP 42. The memory device 96 disclosed herein may include one or more memory devices (e.g., a volatile memory, such as random access memory [RAM], and/or a nonvolatile memory, such as read-only memory [ROM]) that may store a variety of information and may be used for various purposes. For example, the memory device 96 may store processor-executable instructions (e.g., firmware or software) for the processor 94 to execute, such as instructions for processing signals and/or controlling the components associated with the annular BOP 42. It should be appreciated that the electronic controller 82 may include various other components, such as a communication device 98 that is capable of communicating data or other information to various other devices (e.g., a remote computing system).

Figure 3:
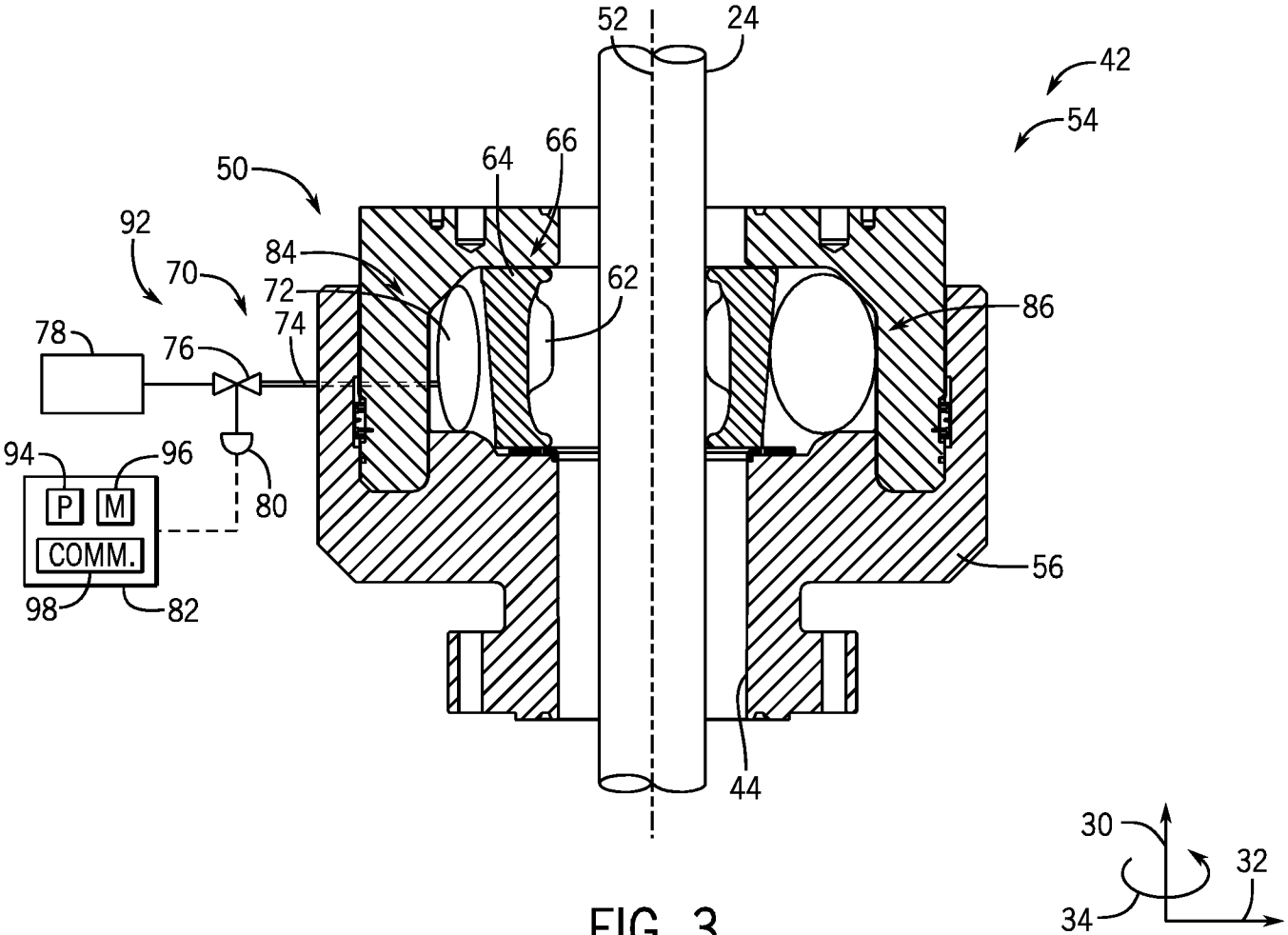
FIG. 3 is a cross-sectional side view of an embodiment of an annular BOP that may be used in the system of FIG. 1, wherein the annular BOP includes an inflatable bladder, a packer, and multiple iris-style inserts.

FIG. 3 is a cross-sectional side view of an embodiment of the annular BOP 42 that may be used in the system 10 of FIG. 1, wherein the multiple inserts 64 are iris-style inserts. The annular BOP 42 of FIG. 3 may operate similarly to the annular BOP 42 of FIG. 2, except that the inserts 64 may be configured and arranged to carry out an iris-style closing (e.g., radially-inward rotation) similar to that of an iris shutter of a camera that acts to block extrusion of the flexible material of the packer 62.

In particular, the annular BOP 42 is shown in the open position 50 on one side of the central axis 52 of the annular BOP 42, and the annular BOP 42 is shown in the closed position 54 on the other side of the central axis 52 of the annular BOP 42. As shown, the annular BOP 42 includes the housing 56, and the packer assembly 60 within the housing 56 includes the packer 62 and the multiple inserts 64. The multiple inserts 64 extend axially through the packer 62 and are positioned at discrete circumferential locations about the packer 62.

As shown, the annular BOP 42 also includes the inflatable bladder system 70 having the inflatable bladder 72, which circumferentially surrounds the packer assembly 60 and is positioned between the packer assembly 60 and side walls of the housing 56 along the radial axis 32. The inflatable bladder system 70 may also include the inflation conduit 74, the valve 76, the fluid source 78, the actuator 80, and the electronic controller 82. Upon an undesired increase in pressure within the wellbore, the inflatable bladder system 70 may cause the fluid to flow from the fluid source 78 to the inflatable bladder 72 via the inflation conduit 74. In this way, the inflatable bladder system 70 may inflate the inflatable bladder 72 from the deflated state 84 to the inflated state 86 in response to the increase in pressure within the wellbore.

In the illustrated embodiment, as the inflatable bladder 72 inflates, the inflatable bladder 72 may contact and exert a force on the packer assembly 60 that drives the packer assembly 60 radially-inwardly into the central bore 44 of the annular BOP 42, thereby enabling the packer 62 to contact and seal against the conduit 24 to block the fluid flow across the annular BOP 42. As the inflatable bladder 72 drives the packer assembly 60 radially-inwardly into the central bore 44 of the annular BOP 42, the multiple inserts 64 carry out the iris-style closing by sliding against one another and rotating circumferentially relative to the central bore 44.

In FIGS. 2 and 3, the annular BOP 42 is devoid of a donut (e.g., flexible annular structure) that circumferentially surrounds the packer assembly 60. Instead, the inflatable bladder 72 directly contacts and extends radially between a portion of the packer assembly 60 (e.g., the packer 62 and/or the multiple inserts 64) and the side walls of the housing 56. Indeed, the inflatable bladder 72 and the packer assembly 60 (e.g., the packer 62 and the multiple inserts 64) may be the only adjustable (e.g., movable; capable of changing shapes) components that are positioned within a cavity of the housing 56 and that adjust to transition the annular BOP 42 to the closed position 54.

However, it should be appreciated that a donut may be included and may be positioned to circumferentially surround the packer assembly 60. In such cases, the inflatable bladder 72 may be positioned in any of a variety of locations relative to the donut. For example, FIG. 4 is a cross-sectional side view of an embodiment of the annular BOP 42 that may be used in the system 10 of FIG. 1, wherein the annular BOP 42 includes the inflatable bladder 72 positioned vertically below a donut 100, the packer 62, and the multiple inserts 64 (e.g., relative to the wellbore, such as the wellbore 26 of FIG. 1, along the axial axis 30).

Figure 4:
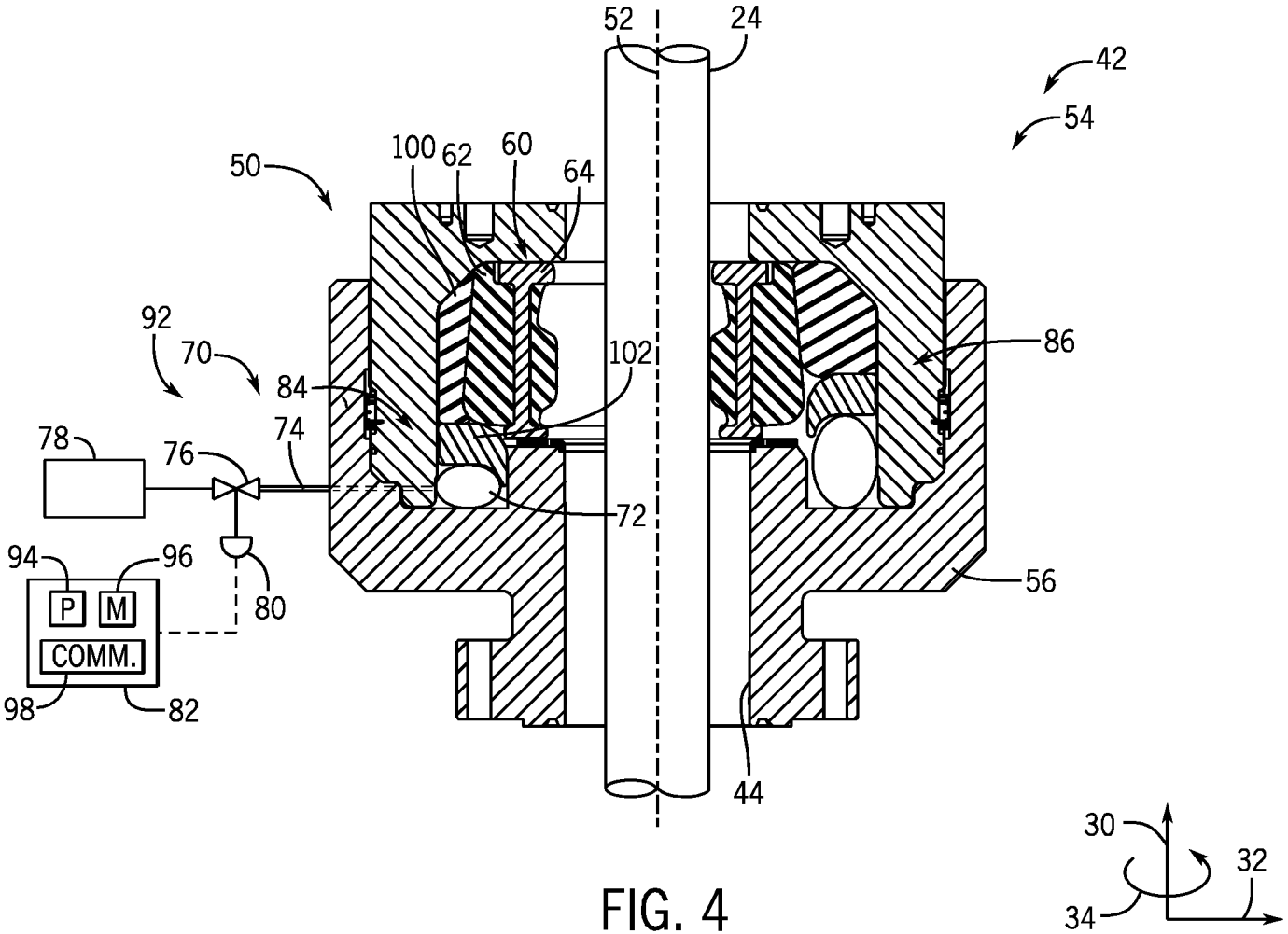
FIG. 4 is a cross-sectional side view of an embodiment of an annular BOP that may be used in the system of FIG. 1, wherein the annular BOP includes an inflatable bladder, a donut, a packer, and multiple iris-style inserts.

In FIG. 4, the annular BOP 42 is shown in the open position 50 on one side of the central axis 52 of the annular BOP 42, and the annular BOP 42 is shown in the closed position 54 on the other side of the central axis 52 of the annular BOP 42. As shown, the annular BOP 42 includes the housing 56, and the packer assembly 60 within the housing 56 includes the packer 62 and the multiple inserts 64. The multiple inserts 64 extend axially through the packer 62 and are positioned at discrete circumferential locations about the packer 62. The donut 100 circumferentially surrounds the packer assembly 60 and is positioned between the packer assembly 60 and side walls of the housing 56 along the radial axis 32. In some embodiments, as shown, a push plate 102 (e.g., annular plate) may be positioned vertically below the donut 100, the packer 62, and the multiple inserts 64.

The annular BOP 42 also includes the inflatable bladder system 70 having the inflatable bladder 72, which is positioned vertically below the donut 100, the packer assembly 60, and the push plate 102. The inflatable bladder system 70 may also include the inflation conduit 74, the valve 76, the fluid source 78, the actuator 80, and the electronic controller 82. Upon an undesired increase in pressure within the wellbore, the inflatable bladder system 70 may cause the fluid to flow from the fluid source 78 to the inflatable bladder 72 via the inflation conduit 74. In this way, the inflatable bladder system 70 may inflate the inflatable bladder 72 in response to the increase in pressure within the wellbore.

As shown, the inflatable bladder 72 may contact and exert a force (e.g., along the axial axis 30) against the push plate 102 at least while the inflatable bladder 72 is in the inflated state 86 and the annular BOP 42 is in the closed position 54. The push plate 102 may contact and transfer the force to the donut 100, the packer 62, and/or the multiple inserts 64 at least while the inflatable bladder 72 is in the inflated state 86 and the annular BOP 42 is in the closed position 54.

Thus, as the inflatable bladder 72 inflates, the inflatable bladder 72 may drive the push plate 102, the donut 100, and/or packer assembly 60 vertically upward within the housing 56. When driven vertically upward in this way, the packer assembly 60 may also move radially-inwardly into the central bore 44 of the annular BOP 42 (e.g., guided by top surfaces of the housing 56 and/or the top surface of the push plate 102), thereby enabling the packer 62 to contact and seal against the conduit 24 to block the fluid flow across the annular BOP 42. As the inflatable bladder 72 drives the packer assembly 60 vertically upward and radially-inwardly into the central bore 44 of the annular BOP 42, the multiple inserts 64 shown in FIG. 4 may carry out the iris-style closing by sliding against one another and rotating circumferentially relative to the central bore 44.

Figure 5:
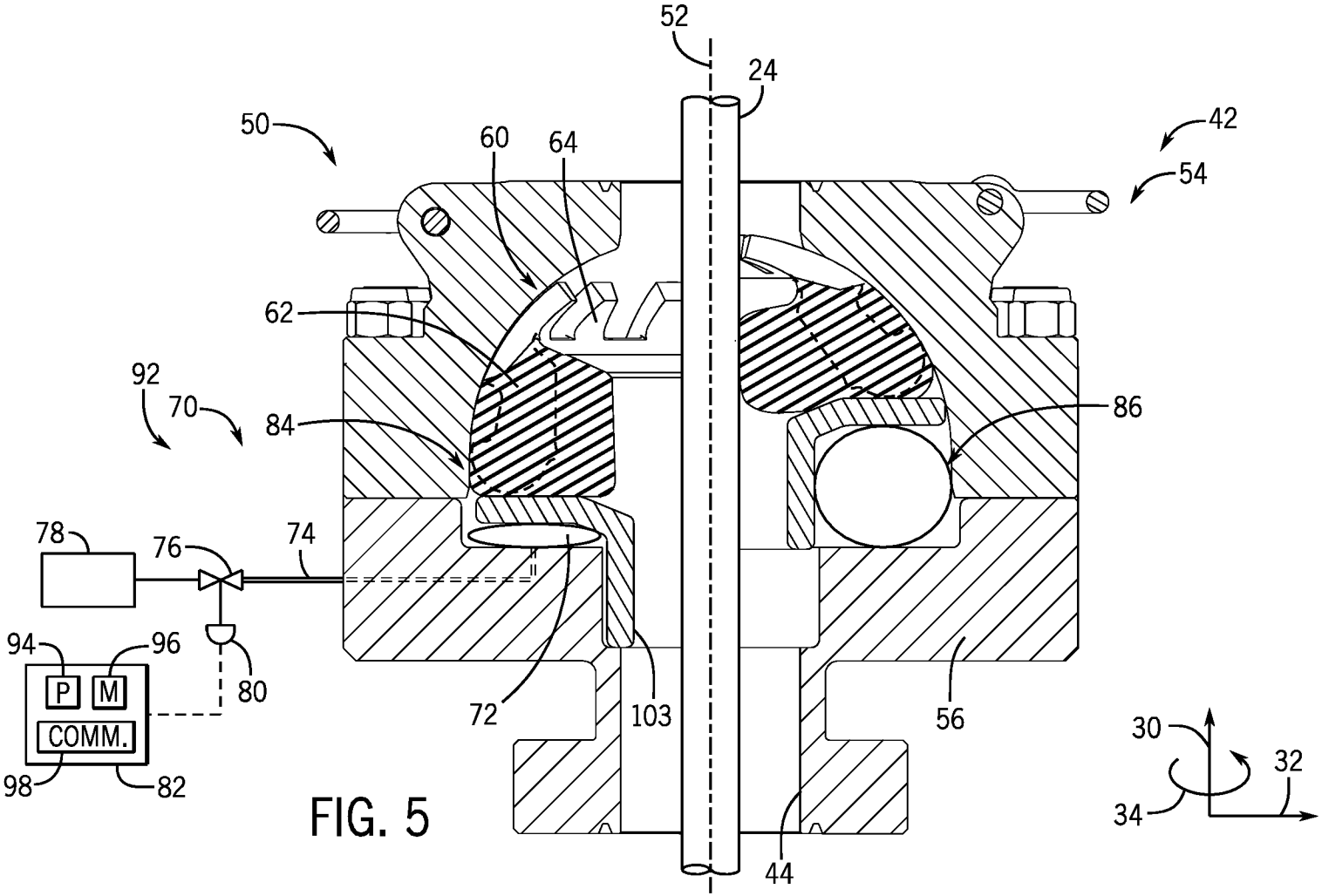
FIG. 5 is a cross-sectional side view of an embodiment of an annular BOP that may be used in the system of FIG. 1, wherein the annular BOP includes an inflatable bladder positioned vertically below a packer and multiple inserts.

It should be appreciated that the inflatable bladder 72 may be positioned vertically below the packer assembly 60 in other configurations. For example, FIG. 5 is a cross-sectional side view of an embodiment of the annular BOP 42 that may be used in the system 10 of FIG. 1, wherein the annular BOP 42 includes the inflatable bladder 72 positioned vertically below the packer assembly 60. As shown, the annular BOP 42 is shown in the open position 50 on one side of the central axis 52 of the annular BOP 42, and the annular BOP 42 is shown in the closed position 54 on the other side of the central axis 52 of the annular BOP 42. Additionally, the annular BOP 42 includes the housing 56, and the packer assembly 60 within the housing 56 includes the packer 62 and the multiple inserts 64. The multiple inserts 64 extend axially through the packer 62 and are positioned at discrete circumferential locations about the packer 62.

The annular BOP 42 also includes the inflatable bladder system 70 having the inflatable bladder 72, which is positioned vertically below the packer assembly 60. The inflatable bladder system 70 may also include a push plate 103 (e.g., annular push plate), the inflation conduit 74, the valve 76, the fluid source 78, the actuator 80, and the electronic controller 82. Upon an undesired increase in pressure within the wellbore, the inflatable bladder system 70 may cause the fluid to flow from the fluid source 78 to the inflatable bladder 72 via the inflation conduit 74. In this way, the inflatable bladder system 70 may inflate the inflatable bladder 72 in response to the increase in pressure within the wellbore. As shown, the inflatable bladder 72 may contact the push plate 103 at least while the inflatable bladder 72 is in the inflated state 86 and the annular BOP 42 is in the closed position 54. The push plate 103 may have a shape (e.g., an axially-extending segment) that blocks extrusion of the inflatable bladder 72 into the central bore 44. However, in some embodiments, the annular BOP 42 may not include the push plate 103, and instead, the inflatable bladder 72 may contact the packer 62 and/or the multiple inserts 64.

In the illustrated embodiment, as the inflatable bladder 72 inflates, the inflatable bladder 72 may contact and/or exert a force on the packer assembly 60 that drives the packer assembly 60 vertically upward within the housing 56. When driven vertically upward in this way, the packer assembly 60 may also move radially-inwardly into the central bore 44 of the annular BOP 42 (e.g., guided by curved surfaces of the housing 56), thereby enabling the packer 62 to contact and seal against the conduit 24 to block the fluid flow across the annular BOP 42.

Figure 6:
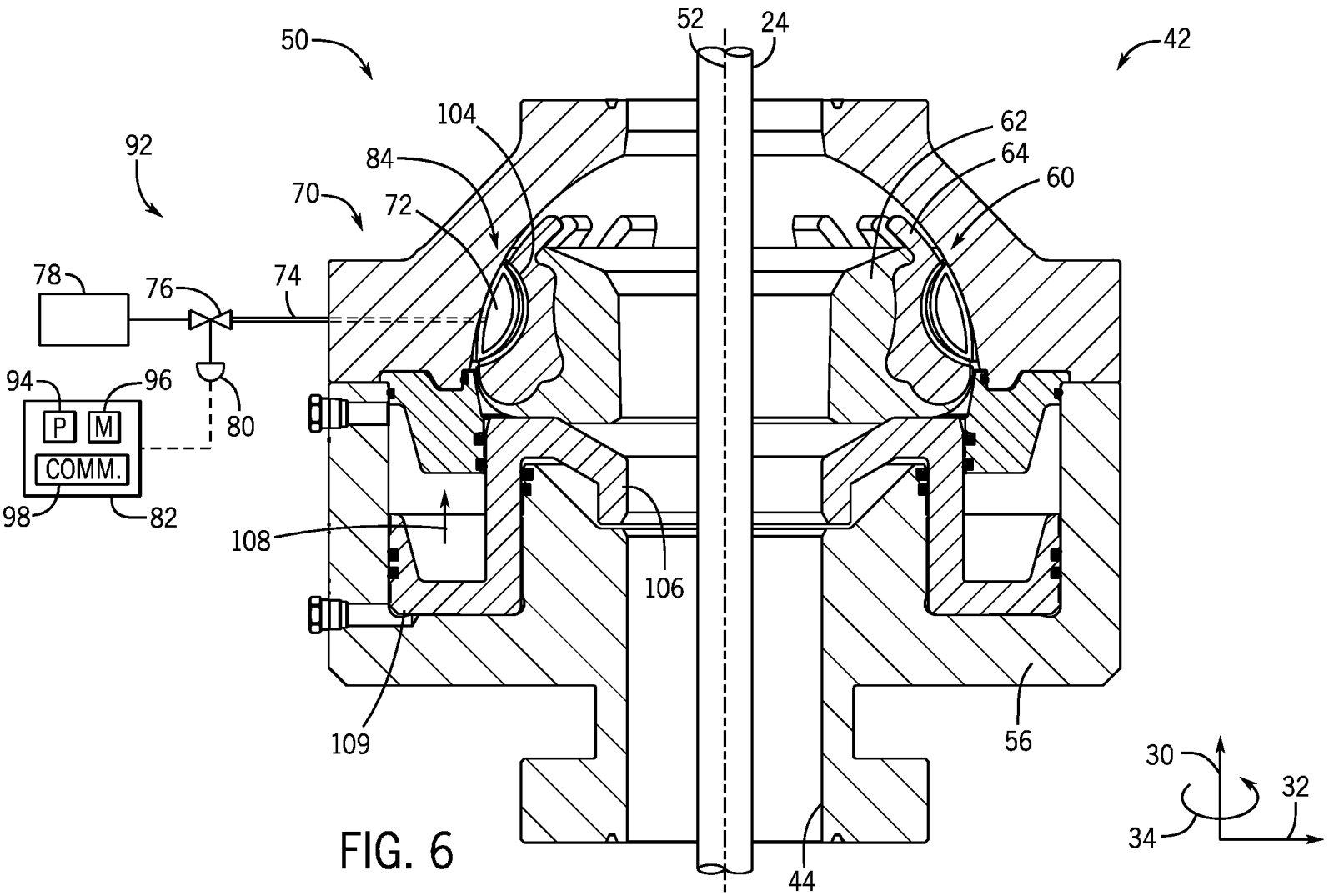
FIG. 6 is a cross-sectional side view of an embodiment of an annular BOP that may be used in the system of FIG. 1, wherein the annular BOP includes an inflatable bladder and a piston.

In some embodiments, the inflatable bladder 72 may drive the packer assembly 60 radially-inwardly without rotation (e.g., without rotation in the circumferential direction 34) and/or a shape of the packer assembly 60 may adapted to receive (e.g., mate with; accommodate) the inflatable bladder 72. For example, FIG. 6 is a side view of an embodiment of the annular BOP 42 that may be used in the system 10 of FIG. 1, wherein the annular BOP 42 includes the inflatable bladder system 70 having the inflatable bladder 72 positioned within a recess 104 (e.g., annular recess) formed in a radially-outer surface of the packer assembly 60. The inflatable bladder system 70 may also include the inflation conduit 74, the valve 76, the fluid source 78, the actuator 80, and the electronic controller 82. Additionally, the annular BOP 42 includes the housing 56, and the packer assembly 60 within the housing 56 includes the packer 62 and the multiple inserts 64. The multiple inserts 64 extend axially through the packer 62 and are positioned at discrete circumferential locations about the packer 62.

Upon an undesired increase in pressure within the wellbore, the inflatable bladder system 70 may cause the fluid to flow from the fluid source 78 to the inflatable bladder 72 via the inflation conduit 74. In this way, the inflatable bladder system 70 may inflate the inflatable bladder 72 in response to the increase in pressure within the wellbore. Additionally, upon the undesired increase in pressure within the wellbore, a piston 106 (e.g., annular piston) may move in a direction 108 in response to a fluid being delivered to a space 109 (e.g., annular space). Thus, the inflatable bladder 72 may work in conjunction with the piston 106 to adjust the annular BOP 42 from the illustrated open position 50 to the closed position 54, which may place the packer assembly 60 in a similar position as shown in FIG. 5.

In the illustrated embodiment, as the inflatable bladder 72 inflates, the inflatable bladder 72 may exert a respective force on the packer assembly 60 that drives the packer assembly 60 radially-inwardly within the housing 56. The piston 106 may also exert a respective force on the packer assembly 60 that drives the packer assembly 60 vertically-upwardly within the housing 56, which may also further drive the packer assembly 60 radially-inwardly into the central bore 44 of the annular BOP 42 (e.g., guided by curved surfaces of the housing 56). In this way, the inflatable bladder 72 and the piston 106 may enable the packer 62 to contact and seal against the conduit 24 to block the fluid flow across the annular BOP 42.

Figure 7:
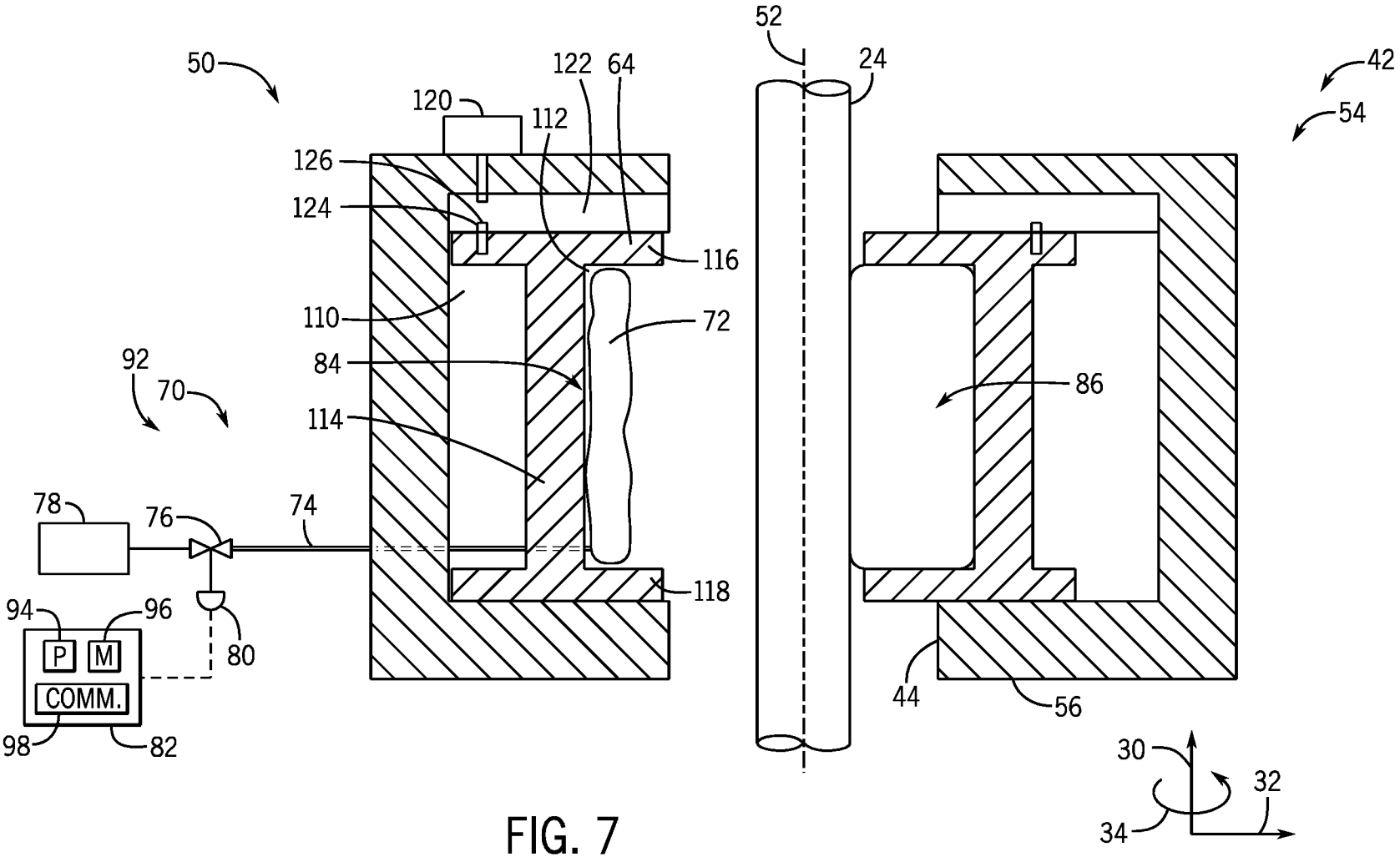
FIG. 7 is a cross-sectional side view of an embodiment of an annular BOP that may be used in the system of FIG. 1, wherein the annular BOP includes an inflatable bladder configured to contact and seal against a conduit within a bore of the annular BOP.

FIGS. 2-6 illustrate various embodiments in which the inflatable bladder 72 is configured to drive the packer assembly 60 to contact and to seal against the conduit 24 to adjust the annular BOP 42 to the closed position 54. However, it should be appreciated that the inflatable bladder 72 may instead be configured to contact and to seal against the conduit 24 in the central bore 44 of the annular BOP 42. For example, FIG. 7 is a cross-sectional side view of an embodiment of the annular BOP 42 that may be used in the system 10 of FIG. 1, wherein the annular BOP 42 includes the inflatable bladder 72 that is configured to contact and to seal against the conduit 24 within the central bore 44 of the annular BOP 42.

The annular BOP 42 is shown in the open position 50 on one side of the central axis 52 of the annular BOP 42, and the annular BOP 42 is shown in the closed position 54 on the other side of the central axis 52 of the annular BOP 42. Additionally, the annular BOP 42 includes the multiple inserts 64 positioned within the housing 56. The annular BOP 42 also includes the inflatable bladder system 70 having the inflatable bladder 72 positioned within the housing 56. In particular, the multiple inserts 64 and the inflatable bladder 72 may be positioned within a cavity 110 (e.g., annular cavity) of the housing 56. Furthermore, the inflatable bladder 72 may be positioned within multiple insert cavities 112 (e.g., recesses) of the multiple inserts 64. For example, each insert 64 may include an axially-extending portion 114, as well as a radially-extending upper portion 116 and a radially-extending lower portion 118 that are spaced apart from one another along the axial axis 30. Thus, the insert cavities 112 may be defined along the axial axis 30 by the radially-extending upper portion 116 and radially-extending lower portion 118, and the arrangement of the portions 114, 116, 118 enable the inflatable bladder 72 to be withdrawn from the central bore 44 of the annular BOP 42 while the inflatable bladder 72 is in the deflated state 84 and while the annular BOP 42 is in the open position 50. Together, the insert cavities 112 of the multiple inserts 64 form an annular recess that supports the inflatable bladder 72.

The inflatable bladder system 70 may also include the inflation conduit 74, the valve 76, the fluid source 78, the actuator 80, and the electronic controller 82. Upon an undesired increase in pressure within the wellbore, the inflatable bladder system 70 may cause the fluid to flow from the fluid source 78 to the inflatable bladder 72 via the inflation conduit 74. In this way, the inflatable bladder system 70 may inflate the inflatable bladder 72 in response to the increase in pressure within the wellbore. The inflatable bladder 72 may completely or substantially (e.g., approximately equal to or greater than 95, 90, 85, 80, or 75 percent) fill the insert cavities 112 while the inflatable bladder 72 is in the inflated state 86. The inflation conduit 74 may be positioned in any of a variety of locations. For example, the inflation conduit 74 may generally extend through the housing 56 and/or may extend between adjacent inserts 64 to reach the inflatable bladder 72. In some embodiments, a radially-extending notch or gap may be provided between adjacent inserts 64 to receive the inflation conduit 74 and to enable the inflatable bladder 72 to receive the fluid from the fluid source 78.

In some embodiments, the multiple inserts 64 may be driven radially inwardly into the central bore 44 prior to and/or as the inflatable bladder 72 is inflated. In this way, the multiple inserts 64 may support and/or block extrusion of the inflatable bladder 72 while the inflatable bladder is in the inflated state 86. The multiple inserts 64 may be rotated radially-inwardly via any suitable technique. In some cases, the annular BOP 42 may include an iris assembly that is configured to convert rotational motion output by one or more motors 120 into rotational motion of the inserts 64 and to drive the inserts 64 toward the central axis 52. For example, in some embodiments, the one or more motors 120 may rotate a plate 122 that is coupled to each insert 64 via a respective key-slot interface. The key-slot interface may include a groove 124 (e.g., radially extending groove) formed in the plate 122 and that receives a pin 126 coupled to the insert 64. As the one or more motors 120 rotate the plate 122, the pin 126 may slide in the groove 124 and cause the inserts 64 to move radially-inwardly (e.g., rotate radially-inwardly). Thus, upon the undesired increase in pressure within the wellbore, the electronic controller 82 may generate a control signal to instruct the actuator 80 to open the valve 76 to enable the flow of the fluid from the fluid source 78 to the inflatable bladder 72 via the inflation conduit 74 and may generate a control signal to instruct the one or more motors 120 to drive the multiple inserts 64 radially inwardly.

The movement of the multiple inserts 64 and the inflation of the inflatable bladder 72 may be coordinated to reduce or to block extrusion of the inflatable bladder 72. For example, the electronic controller 82 may provide the control signals in a manner that causes the multiple inserts 64 to move fully radially-inwardly into the central bore 44 (e.g., to a radially-innermost position) prior to the initiation of inflation of the inflatable bladder 72 and/or prior to the inflatable bladder 72 inflating sufficiently to seal the central bore 44. Together, the multiple inserts 64 and the inflatable bladder system 70 may form the inflatable packer system 92 that operates to transition the annular BOP 42 between the open position 50 and the closed position 54. The packer assembly 60 may also include an additional sealing element (e.g., a packer, an additional inflatable bladder) positioned about the inserts 64 to block the fluid in the central bore 44 from leaking around the packer assembly 60.

Figure 8:
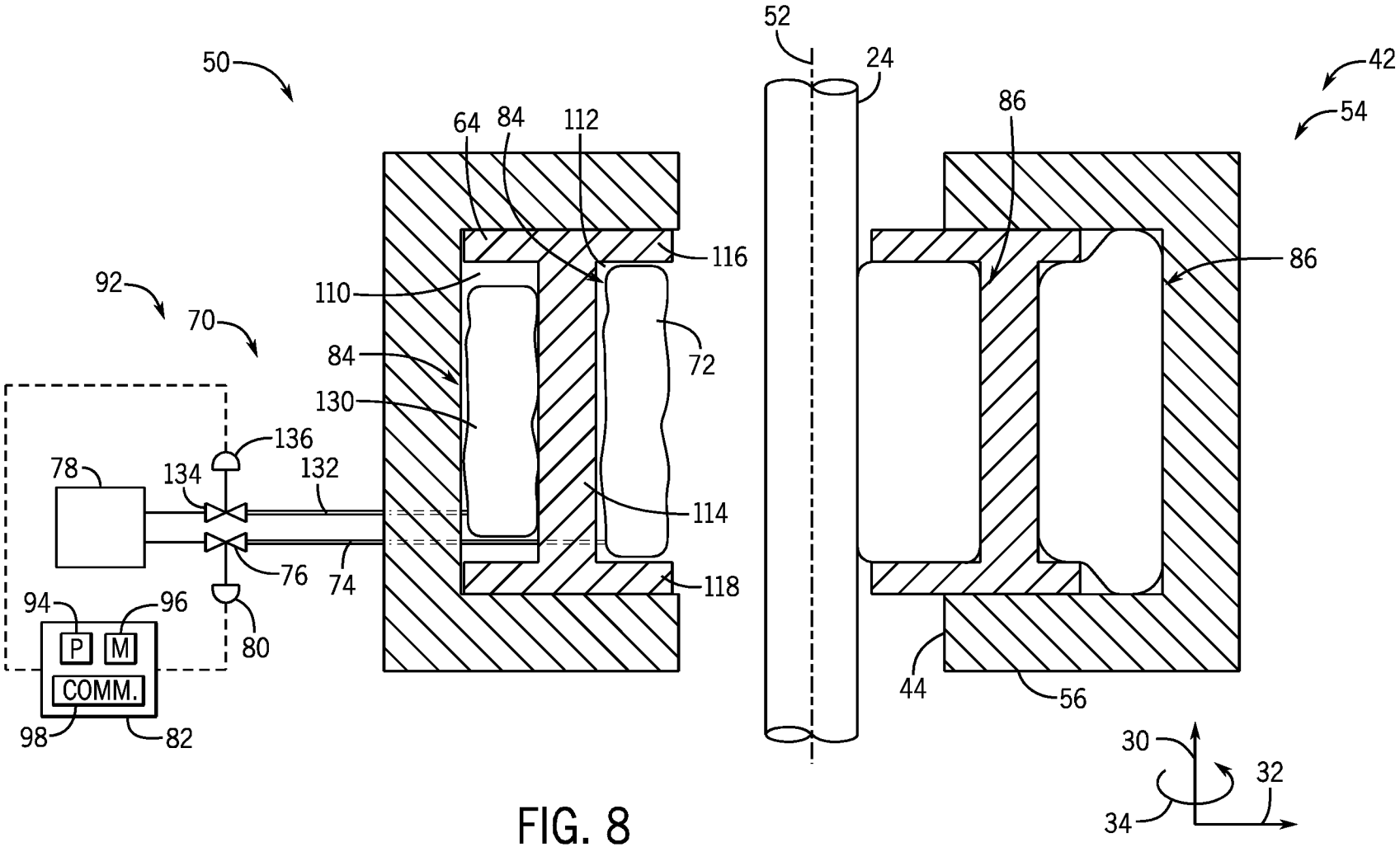
FIG. 8 is a cross-sectional side view of an embodiment of an annular BOP that may be used in the system of FIG. 1, wherein the annular BOP includes an inflatable bladder, an additional inflatable bladder, and multiple inserts.

For example, FIG. 8 is a cross-sectional side view of an embodiment of the annular BOP 42 that may be used in the system 10 of FIG. 1, wherein the annular BOP 42 includes the multiple inserts 64, the inflatable bladder 72, and an additional inflatable bladder 130. The multiple inserts 64 and the inflatable bladder 72 of FIG. 8 operate similarly to the multiple inserts 64 and the inflatable bladder 72 of FIG. 7. However, instead of the one or more motors 120, the additional inflatable bladder 130 is provided to drive the multiple inserts 64 and the inflatable bladder 72 radially inwardly to seal the central bore 44 of the annular BOP 42. It should be appreciated that the one or more motors 120 of FIG. 7 and the additional inflatable bladder 130 may be used together, in some embodiments.

The annular BOP 42 is shown in the open position 50 on one side of the central axis 52 of the annular BOP 42, and the annular BOP 42 is shown in the closed position 54 on the other side of the central axis 52 of the annular BOP 42. Additionally, the annular BOP 42 includes the multiple inserts 64 positioned within the housing 56. The annular BOP 42 also includes the inflatable bladder system 70 having the inflatable bladder 72 and the additional inflatable bladder 130 positioned within the housing 56. The inflatable bladder system 70 may also include the inflation conduit 74, the valve 76, the fluid source 78, the actuator 80, and the electronic controller 82. The inflatable bladder system 70 may further include an additional inflation conduit 132, an additional valve 134, and an additional actuator 136.

Upon an undesired increase in pressure within the wellbore, the electronic controller 82 may generate a control signal to instruct the actuator 80 to open the valve 76 to enable the flow of the fluid from the fluid source 78 to the inflatable bladder 72 via the inflation conduit 74. Similarly, the electronic controller 82 may generate a control signal to instruct the additional actuator 136 to open the additional valve 134 to enable the flow of the fluid from the fluid source 78 to the additional inflatable bladder 130 via the additional inflation conduit 132. In this way, the inflatable bladder system 70 may inflate the inflatable bladder 72 and the additional inflatable bladder 130 in response to the increase in pressure within the wellbore.

The inflation of the inflatable bladder 72 and the additional inflatable bladder 130 may be coordinated to reduce or to block extrusion of the inflatable bladder 72. For example, the electronic controller 82 may provide the control signals in a manner that causes the additional inflatable bladder 130 to inflate to drive the multiple inserts 64 radially inwardly into the central bore 44 (e.g., to a radially-innermost position) prior to the initiation of inflation of the inflatable bladder 72 and/or prior to the inflatable bladder 72 inflating sufficiently to seal the central bore 44. Together, the multiple inserts 64 and the inflatable bladder system 70 may form the inflatable packer system 92 that operates to transition the annular BOP 42 between the open position 50 and the closed position 54. It should be appreciated that the inflatable bladder 72 and the additional inflatable bladder 130 may contact and seal against one another (e.g., between adjacent inserts 64) at least while the annular BOP 42 is in the closed position 54, thereby blocking the fluid in the central bore 44 from leaking around the packer assembly 60.

Figure 9:
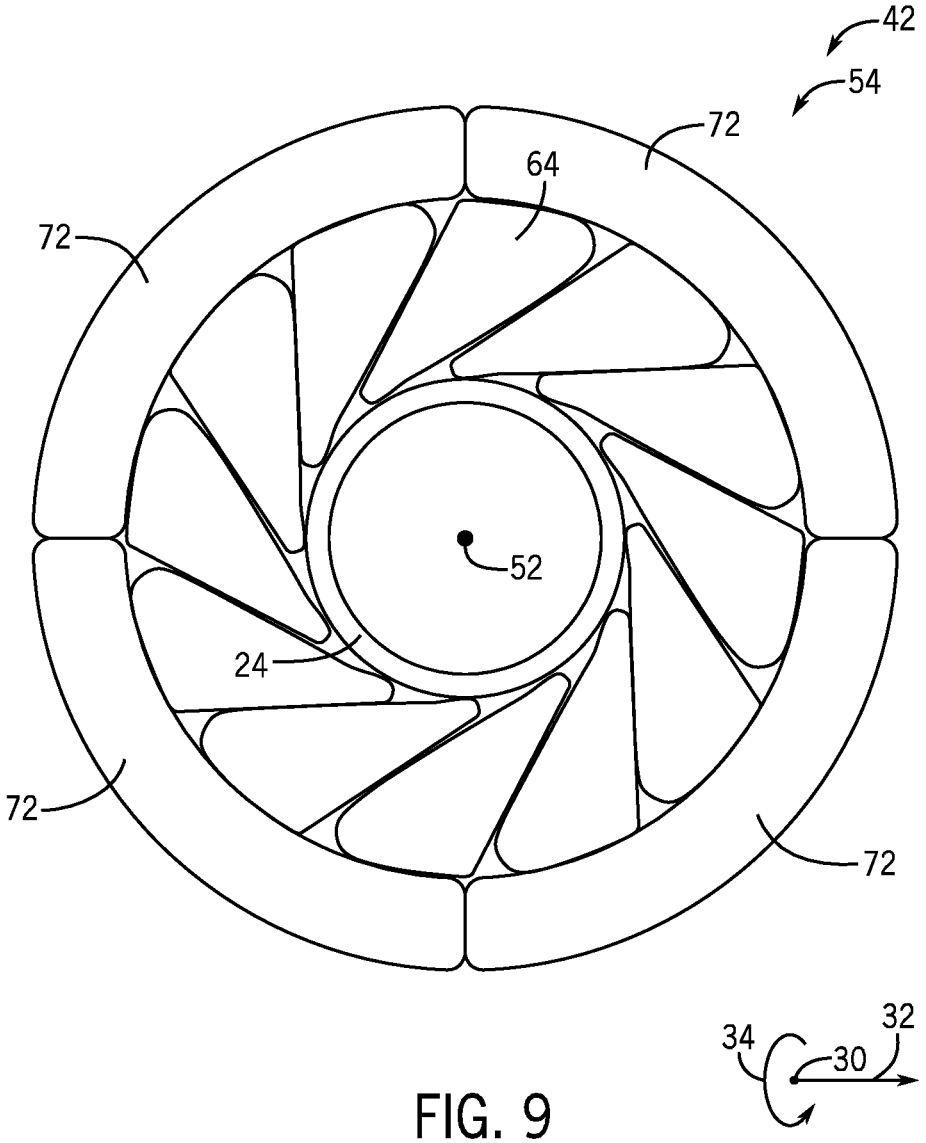
FIG. 9 is a cross-sectional top view of an embodiment of an annular BOP that may be used in the system of FIG. 1, wherein the annular BOP includes multiple inflatable bladders positioned circumferentially about a packer assembly.

It should be appreciated that the multiple inserts 64 of FIGS. 7 and 8 may be similar to any of the inserts of FIGS. 2-6. For example, the multiple inserts 64 may be configured to move radially-inwardly without rotation about the vertical axis 30 in the circumferential direction 34 or the multiple inserts 64 may be iris-style inserts that rotate radially-inwardly as the multiple inserts 64 move into the central bore 44 of the annular BOP 42. The embodiments illustrated and described herein may have various other features. For example, instead of the inflatable bladder 72 being annular as shown in FIGS. 2-8, multiple inflatable bladders 72 may be positioned at discrete circumferential locations. An example of this configuration is shown in FIG. 9, in which the multiple inflatable bladders 72 are positioned to circumferentially surround the packer assembly 60. In operation, due to inflation of the multiple inflatable bladders 72, the packer assembly 60 may be driven radially-inwardly to seal against the conduit 24 within the central bore 44 of the annular BOP 42. While four inflatable bladders 72 are shown in FIG. 9, the annular BOP 42 may include any number of inflatable bladders 72 (e.g., 1, 2, 3, 4, 5, 6, 7, 8, 9, 10, or more). Furthermore, while FIG. 9 illustrates the multiple inserts 64 that rotate radially-inwardly, additional components may be included to effectuate the seal against the conduit 24. The multiple inflatable bladders 72 may be used in any of the configurations shown in FIGS. 2-8, and the annular BOP 42 of may also include multiple additional inflatable bladders 130 (FIG. 8).

In some embodiments, the inflatable bladder system 70 may be configured to effectuate a lock (e.g., hydraulic or pneumatic lock). For example, in FIGS. 2-7, once the inflatable bladder 72 is inflated to the inflated state 86, the valve 76 may be adjusted to a closed position to block the flow of the fluid out of the inflatable bladder 72. In this way, the annular BOP 42 may be locked in its closed position 54. Furthermore, once the inflatable bladder 72 is inflated and filled with the fluid, the fluid may be drained (e.g., via the inflation conduit 74) to return the annular BOP 42 to the open position 50. It should be appreciated that any suitable fluid may be used to inflate the inflatable bladder 72. For example, any suitable liquid or gas may be used to inflate the inflatable bladder 72. In some embodiments, a non-Newtonian fluid (e.g., viscosity varies with stress) may be used to inflate the inflatable bladder 72, which may improve the seal and/or the lock. The fluid within the inflatable bladder 72 may also have sufficient pressure (e.g., greater than wellbore pressure) to effectuate the seal and/or the lock against wellbore pressure. Furthermore, while the embodiments illustrated in FIGS. 2-8 illustrate the conduit 24, it should be appreciated that the annular BOP 42 may be configured to seal the central bore 44 in the absence of the conduit 24 (e.g., the packer assembly 60 of FIGS. 2-6 may seal the central bore 44 and/or the inflatable bladder 72 of FIGS. 7 and 8 may seal the central bore 44).

It is envisioned that the inflatable bladder 72 and/or the other components of the inflatable bladder system 70 may be adapted for use in any of a variety of annular BOPs 42 having any of a variety of structural features. Accordingly, it should be understood that the annular BOP 42 of FIGS. 2-9 are merely exemplary and are not intended to be limiting. For example, the housing 56, the packer 62, and/or the multiple inserts 64 may have various other shapes and configurations. Furthermore, it should be understood that any of the various components, features, or characteristics illustrated or described above with respect to FIGS. 1-9 may be combined. For example, a push plate (e.g., the push plate 102 of FIG. 4) may be positioned between the packer assembly 60 and the inflatable bladder 72 in any of the embodiments, or the push plate 102 of FIG. 4 may be omitted. As another example, multiple inflatable bladders 72 may be used instead of the single inflatable bladder 72 shown in FIGS. 2-8. The disclosed embodiments may enable the annular BOP 42 to have a low number of components and/or a compact size of the annular BOP 42 (e.g., compared to some existing annular BOPs), among other advantages.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An inflatable packer system for an annular blowout preventer (BOP), comprising:

a first inflatable bladder configured to be positioned within a housing of the annular BOP and to inflate upon receipt of a fluid within the first inflatable bladder;

a plurality of inserts configured to support the first inflatable bladder, the plurality of inserts disposed circumferentially about the first inflatable bladder; and a second inflatable bladder disposed circumferentially about the plurality of inserts and configured to inflate upon receipt of the fluid within the second inflatable bladder.

2. The inflatable packer system of claim 1, wherein the first inflatable bladder is an annular structure configured to circumferentially surround a bore of the annular BOP.

3. The inflatable packer system of claim 1, wherein the first inflatable bladder is configured to contact and to seal against a conduit extending through a bore of the annular BOP.

4. The inflatable packer system of claim 1, further comprising a fluid conduit that is configured to deliver the fluid from a fluid source to the first inflatable bladder.

5. The inflatable packer system of claim 1, further comprising a fluid source, a first valve, and an electronic controller, wherein the electronic controller is configured to instruct actuation of the first valve to enable the fluid from the fluid source to flow into the first inflatable bladder upon receipt of a signal that indicates an increase in a wellbore pressure.

6. The inflatable packer system of claim 5, further comprising a second valve, wherein the electronic controller is further configured to instruct actuation of the second valve to enable the fluid from the fluid source to flow into the second inflatable bladder and inflate the second inflatable bladder prior to the first inflatable bladder inflating sufficiently to seal a bore of the annular BOP.

7. An annular blowout preventer (BOP), comprising:

a housing;

a first inflatable bladder positioned within the housing and configured to adjust from a deflated state to an inflated state;

a plurality of inserts disposed within the housing and configured to support the first inflatable bladder, the plurality of inserts disposed circumferentially about the first inflatable bladder; and a second inflatable bladder disposed within the housing and circumferentially about the plurality of inserts and configured to adjust from a deflated state to an inflated state.

8. The annular BOP of claim 7, wherein the first inflatable bladder is configured to contact and to seal against a conduit extending through a bore of the annular BOP while the first inflatable bladder is in the inflated state.

9. The annular BOP of claim 7, comprising a first fluid conduit that is configured to deliver a fluid from a fluid source to the first inflatable bladder.

10. The annular BOP of claim 7, further comprising a fluid source, a first valve, and an electronic controller, wherein the electronic controller is configured to instruct actuation of the first valve to enable the fluid from a fluid source to flow into the first inflatable bladder upon receipt of a signal that indicates an increase in a wellbore pressure.

11. The annular BOP of claim 10, further comprising a second valve, wherein the electronic controller is further configured to instruct actuation of the second valve to enable the fluid from the fluid source to flow into the second inflatable bladder and inflate the second inflatable bladder prior to the first inflatable bladder inflating sufficiently to seal a bore of the annular BOP.

12. A method of operating an annular blowout preventer (BOP), comprising:

providing a fluid to a second inflatable bladder to inflate the second inflatable bladder, wherein the second inflatable bladder is disposed within a housing of the annular BOP and circumferentially about a plurality of inserts disposed within the housing;

driving, via the inflated second inflatable bladder, the plurality of inserts radially inwardly, wherein the plurality of inserts are disposed circumferentially about a first inflatable bladder disposed within the housing; and providing the fluid to the first inflatable bladder to inflate the first inflatable bladder, thereby sealing a bore of the annular BOP.

13. The method of claim 12, wherein the second inflatable bladder is inflated prior to the first inflatable bladder inflating sufficiently to seal a bore of the annular BOP.

* * * * *